United States Patent [19]

Johnson et al.

[11] 4,388,126

[45] Jun. 14, 1983

[54] MULTI-COMPONENT PROPELLANT CHARGES

[75] Inventors: Craig Johnson, Indian Head, Md.; Paul Dendor, Alexandria, Va.; Harry L. Hodgkins, Upper Marlboro, Md.

[73] Assignee: The United States of America as represented by the Secretary of the Navy, Washington, D.C.

[21] Appl. No.: 189,428

[22] Filed: Sep. 22, 1980

[51] Int. Cl.[3] ..... C06B 45/12

[52] U.S. Cl. ..... 149/14; 149/15; 149/47; 149/76; 149/78; 149/88

[58] Field of Search ..... 60/255; 149/14, 15, 149/47, 76, 78, 88

[56] References Cited

U.S. PATENT DOCUMENTS 3,245,849 4/1966 Klager et al. ..... 149/19.4

*Primary Examiner*—Stephen J. Lechert, Jr.

*Attorney, Agent, or Firm*—R. S. Sciascia; A. L. Branning; T. E. McDonnell

[57] ABSTRACT

A multi-component propellant charge is disclosed wherein one component is an energetic high-strength composite resin, which is plasticized by an energetic plasticizer and supports the other components during the high-acceleration stage of the propellant's performance.

14 Claims, No Drawings

MULTI-COMPONENT PROPELLANT CHARGES

BACKGROUND OF THE INVENTION

This invention pertains generally to high-acceleration propellants and particularly to support for these propellants.

High-acceleration rockets subject the propellant charge to severe mechanical stresses which can cause mechanical failure due to cracking, dewetting, unbonding, or permanent deformation. Rockets with the highest acceleration level are those launched from intermediate to large-caliber guns using post-lauched rockets or solid-fuel air-breathing propulsion systems to increase range, payload to a given range, or velocity at the target. These gunlaunched weapons are restricted envelope systems, for example, weight, diameter, length or combination of these variables are restricted by gun-system-imposed restraints. Mechanical failure of the propellant can also cause the propellant to crush the igniter into the exhaust nozzle, causing a detonation of the rocket.

Although maximizing the propulsion system volumetric performance in order to maximize the range, payload, or velocity improvement is the first objective, compromises are usually made in propellant energy, binder system, or other desired characteristics to minimize the mechanical damage to acceptable limits during a gun launch. An example of such a compromise might be to increase the binder content to achieve non-typical high strength at the expense of energy and combustion efficiency. Such compromises are undesirable since they impact adverserly on achievable system performance.

For a support structure to be effective in minimizing mechanical damages, it must have the strength and an almost continuous surface to contain the propellant, while it does not overly restrict the exhaust area of the rocket. One support currently being utilized is a perforated metal plate, but a propellant without a high mechanical strength extrudes through and clogs the perforations, causing a catastrophic failure of the rocket. A support, such as, the one described in U.S. Pat. No. 3,807,171 issued to Stanley Anderson, which is star-shaped and extends almost the entire length of the rocket casing, is effective only if the propellant is not too thick on the support. The flexible and frangible boot of the U.S. Pat. No. 3,609,977 issued to Joseph B. McCormack is primarily used to prevent a premature ignition of the rocket propellant before substantial completion of the initial booster phase. Resistance to mechanical failure arises primarily from the strength of the main propellant component.

Multi-component propellants have been used previously, usually one component is a high thrust propellant for lift off but numerous other uses have been served. From U.S. Pat. No. 3,858,392, issued to Evan et al. on Jan. 7, 1975, a first stage ignition is used to heat an adjacent second stage.

Polyurethane has often been used as a resin in composite propellants because of the crack resistance thereof, the adhesive property which allows the propellant to be bonded directly to the rocket chamber lining, rubbery mechanical qualities, low brittle point, excellent resilience and superior aging property. Many polyurethane propellants have been developed; examples are shown in U.S. Pat. No. 3,245,849, issued to Klager et al. on Apr. 12, 1966. Several thousand formulations are disclosed in this patent, including a formulation which comprises an aromatic di-isocyanate, and alkylene diol, a tri-functional crosslinker, an oxidizer, a plasticizer, and other additives such as anti-oxidents.

SUMMARY OF THE INVENTION

It is, therefore, an object of the present invention to provide support to a propellant under high acceleration.

Another object of the present invention is to reduce the physical-strength requirement for high-acceleration a propellant.

Another object of the present invention is to heat the exhaust nozzles prior to propulsion by the rocket.

A further object is to decrease the friction sensitivity of the exhaust end of a rocket, the end which experiences differential spin during gun-launch.

A still further object of the present invention is to insure ignition of a wide variety of propellant formulations, including experimental formulations, with a standard ignitor.

These and other objects are achieved by a multi-component propellant charge, wherein, the component at the aft or exhaust end of the motor has a high crosslink density to obtain the tensile strength and modulus of elasticity necessary to support the rest of the propellant charge, has an energy content sufficient to maintain self-burning so that this component can remove itself before the start of propulsion, and has a low friction sensitivity to minimize the chances of detonation during a tube launch. Since the aft component burns before the thrust component burns, the nozzles are heated before propulsion starts. The support component assures ignition of a wide variety of propellant formulations since it represents a relatively constant ignition-energy requirement to the igniter.

DETAILED DESCRIPTION OF THE INVENTION

Essentially, the support component of the propellant charge comprises an oxidizer in a highly crosslink polyurethane resin. The oxidizer can be any of the commonly used oxidizers, such as, ammonium perchlorate, ammonium nitrate, potassium perchlorate, nitronium perchlorate, lithium perchlorate, or calcium chlorate. The oxidizer is present in an amount at least equal to the stoichiometric amount needed for the complete oxidation of said support component, i.e., the oxygen needed to completely react carbon to $CO_2$, hydrogen to water, and nitrogen to $NO_2$. In terms of weight percentage of the total composition, the oxidizer comprises from about 55 to about 75 weight percent. The particle size is relatively unimportant; however, the particle size should not excess 300 microns. Preferably the particle size is not in excess of 200 microns. It is also preferred that the oxidizer is present in an excess of about 10 percent of the stoichiometric amount.

The polyurethane resin is prepared from a short-chain glycol, a trifunctional crosslinking agent, and a aromatic di-isocyanate. An alkylene glycol having an average molecular weight from about 150 to about 500 or a blend of 2 of more alkylene glycol with a molecular weight from about 150 to about 500 can be used. For example, a poly ethylene glycol with a molecular weight from about 150 to about 250 is blended with a second polyethylene glycol with an average molecular weight from about 350 to about 500 in a second-to-first weight ratio from about 1.8 to about 3.0. Of course a blend of 3 or 4 glycols can be used and different alkylene glycols can be used. The preferred alkylene glycols are polyethylene glycol and polypropylene glycol. Although other alkylene glycols can be used, no advantage is obtained and usually several disadvantages are encountered. The hydroxyl groups of the glycols react with the aromatic di-isocyanate to produce a polyurethane resin. Usually the glycols are added in an amount from about 5 to 8 weight percent of the total composition weight.

A tri-functional compound is included in order to increase the amount of crosslinking in the propellant. The crosslinker is added in a amount such that the equivalence of the crosslinker is from 50 to 150 percent of the equivalance of the alkylene diol, but preferably the two equivalences are about equal. In terms of weight percent of total composition weight the crosslinker is added in an amount from about 2 to 5 weight percent. The preferred crosslinkers are trimethylolpropane, methylene bis orthochloroaniline, glycerol triricinoleate, 1, 2,6-hexanetriol, and mixtures thereof.

The aromatic di-isocyanate is preferably present in a slight excess over the stoichiometric amount. In other words, the di-isocyanate is in an amount such that the NCO:OH ratio is greater than one but not more than about 1.1. Generally this amount is from about 4 to about 10 weight percent of the total composition. The preferred di-isocyanates are 2,4-toluene di-isocyanate, 2,6 toluene di-isocyanate, and phenylene di-isocyanate, and mixtures thereof. Other di-isocyanates can be included so long as they produce a propellant meeting the rigorous requirements in terms of physical strength and sensivity.

To facilitate compounding by improved processing of the propellant and to increase the energy content, an energetic plasticizer is added. Generally any energetic non-volatile organic liquid or low-melting solid can be used. The preferred energetic plasticizers are metriol trinitrate, bis(2,2dinitropropyl)acetal, bis(2,2dinitropropyl) formal, and 2,2-dinitropropyl-4-nitrozapentanoate. Any amount up to about 20 weight percent of the total composition weight has a beneficial effect. The preferred amount is from about 15 to about 20 weight percent.

The above compositions cure to energetic materials with a Young's modulus from 80,000 to 150,000 psi and a maximum strain of at least 1000 psi. Cured energetic materials with these properties provide sufficient strength with a support component of less than 15 percent of the total length of the propellant charge. Generally the support component comprises from 5 to 15 percent of the total length of the charge.

The effectiveness of the subject support component arises from the physical properties of the cured composition which is the result of the chemical interaction of the ingredients. Consequently, any standard compounding technique for composite propellants can be used. Further, any configuration for the support component can be used. It is usually the same as the remaining propellant charge.

In order to further illustrate the practice of the present invention, the following examples are given. It is understood that these examples are given by way of illustration and are not meant to limit the disclosure of the claims to follow in any manner.

EXPERIMENTAL SECTION I

Test Methods

The mechanical properties of the propellant were determined by the use of conventional tensile-testing equipment. Test specimens, which were machined from the propellant grains in the form of dumbbells, were cooled over a range of temperatures. The load-deformation curve was recorded for each test. The data developed included stress, elongation, and Young's modulus.

Strands or straws filled with liquid or cast propellant were used to determine the burning rate of propellant over a pressure range from 300 psi to 1000 psi at a temperature of approximately 75° F. The test method comprised threading fuzed wires from an electric timer through the specimen at regular intervals, placing the specimen in a strand bomb, pressurizing the bomb to the desired temperature and measuring the time of burning between the fuze wires.

The impact test was used to test the ease of initiation of detonation by impact or shock applied to the propellant. A 20 milligram sample was placed on an anvil and a 5 kilogram weight was dropped vertically upon the sample. The impact sensitivity of the sample was calculated as the means drop height or point of 50% probability of explosion.

A sliding friction machine was used to measure the sensitivity of the samples to initiation and combustion by friction between 2 metal surfaces, one a sliding block and the other a stationary wheel. A 20 mg sample was placed on the block and pressure was applied to the sample by the wheel which was attached to a hydraulic ramp. A 2.2 kilogram pendalum was swung from a predetermined position in such a manner that it struck the end of the block and thereby imparted a velocity to it. The result was recorded in terms of the maximum force which could be applied to the wheel without causing the sample to decompose.

The sensitivity of the sample to ignition by a charge of electrical energy was determined on an electrostatic discharge apparatus, which had a 5000 volt dc source to charge a variable capacitor system. Energy, in the range of 1 to 15 Joules, was released into into the test sample which rested on a metal test plate by means of a steel needle which was connected electrically to the charge condenser bank. Any evidence of decomposition was taken as a positive result. Twenty consecutive negative result was used to define the sensitivity of test sample.

The card-gap test was the NOL large-scale card-gap test which comprises filling a steel tube (3.8 cm × 10 cm) with the explosive to be tested, sealing one end with a plate (referred to as the witness plate), uprighting the tube, placing one or more plastic cards (0.025 cm thick) on top of the filled tube, placing 150 gram of pentolite, and detonating the pentolite. The result is determined by the smallest separation which prevents detonation.

EXPERIMENTAL SECTION II

Preparation of Test Samples

Four samples were prepared in an identical manner. Sample A was prepared by the method which comprised mixing 1.907 grams of polyethylene glycol with a molecular weight of 194 (PEG 194) 3.863 of polyethylene glycol with a molecular weight of 400 (PEG 400), 1.803 grams of trimethylolpropane (TMP), 0.2 grams of phenylbeta napthylamine (PBNA) and 16 grams of 50/50 mixture of bis(2,2 dinitropropyl) acetal and bis(2,2 dinitropropyl) formal (acetal/formal) in a vertical vacuum mixer (60 LP manufactured by ARC, Alexandria, VA.,), which was conditioned by circulating water at 140° F. through the jacket; vacuum mixing the materials for three hours to remove moisture; adding 0.005 grams of solution of 1% dibutyltin dilaurate (DBTDL) in heptane; vacuum mixture at 140° F. for an additional 30 minutes; adding 22 grams of 13.4μ ammonium perchlorate (AP); vacuum mixing at 140° F. for 5 minutes; adding 28 grams of 36μ ammonium perchlorate (AP); vacuum mixing at a 140° F. for 5 minutes; adding 19 grams of 200μ ammonium perchlorate (AP); vacuum mixing for 20 minutes at 140° F. and 10 minutes at 100° F.; adding 7.227 grams of toluene di-isocyanate (TDI); vacuum mixing for 20 minutes at 100° F.; and casting the mixture into test molds for evaluation. The preparation of the other samples differed only in the ingredients.

EXPERIMENTAL SECTION III

The Test Results

The following table summarizes the formulations and experimental results obtained from the four tests samples.

A Young's modulus of at least 9000 psi and a maximum strain of at 900 psi are needed to withstand the acceleration forces acting on a propellant during a high-acceleration event, such as a tube launch. The present formulations had a Young's modulus of well over 100,000 psi and a maximum strain in excess of 1000 psi, even the poorest formulation had a maximum strain of 1232 psi. The sensitivity tests showed that the propellant is significantly less sensitive than the commonly used propellants. Especially important is the friction sensitivity of about 1000 pounds at 8 feet per second.

Obviously many modifications and variations of the present invention are possible in light of the above teachings. It is therefore to be understood that within the scope of the appended claims the invention may be practiced otherwise than as specifically described.

TABLE I

COMPOSITION AND PROPERTIES OF FOUR ENERGETIC SUPPORT FORMULATIONS

| Ingredients | A | B | C | D |
|---|---|---|---|---|
| PEG 194, g | 1.907 | 7.052 | — | 1.907 |
| PEG 400, g | 3.863 | — | — | 3.863 |
| PEG 200, g | — | — | 4,710 | — |
| Trimethylolpropane (TMP), g | 1.803 | 1.648 | 2.100 | 1.803 |
| Dibutyltin dilaurate (DBTDL), g | .0005 | .0005 | .0005 | .005 |
| Acetal/Formal, g | 16.000 | 16.000 | 15.000 | — |
| Metriol Trinitrate (MTN), g | — | — | — | 15.195 |
| Phenylbeta Naphthylamine (PBNA), g | 0.2 | 0.2 | 0.2 | — |
| Ethyl Centralite, g | — | — | — | 1.000 |
| Ammonium Perchlorate (AP) 13,4μ, g | 22.000 | 22.000 | 20.000 | 22.000 |
| Ammonium Perchlorate (AP) 36μ, g | 28.000 | 28.000 | — | 28.000 |
| Ammonium Perchlorate (AP) 200μ, g | 19.000 | 19.000 | 50.000 | 19.000 |
| 2.4 Toluene Diisocyanate(TDI), g | 7.227 | 6.290 | 8.0 | 7.227 |
| Maximum strain psi | 1938 | — | 1232 | 1932 |
| Elongation at Maximum Strain, % | 1.46 | — | 0.8 | 1.56 |
| Young's Modulus, psi | 118,554 | — | 187,000 | 143,130 |
| Burning Rate, 300 psi | 0.386 | — | 0.187 | — |
| Burning Rate, 600 psi | 0.259 | — | .225 | — |
| Burning Rate, 1000 psi | 0.278 | — | .227 | — |
| 5Kg impact sensitivity, mm | 125 | — | — | — |
| Friction sensitivity @ 8 ft. sec, lb. | ≧960 | — | — | — |
| Electrostatic sensitivity, Joules | ≧12.5 | — | — | — |
| Card gap sensitivity, in. | <0.50 | — | — | — |

What is claimed is:

1. A multi-component propellant charge for a gun launched rocket comprising (1) a high-energy fuel-rich thrust propellant component forming the forward portion of the propellant charge; and (2) an high-strength energetic support component forming the rear portion of the propellant charge and comprising (a) from 55 to 75 weight percent of an oxidizer; and (b) a binder which is the reaction product of (i) from 5 to 8 weight percent of a polyalkene glycol having an average molecular weight of from 150 to 500;

(ii) from 2 to 5 weight percent of a trifunctional crosslinking agent capable of reacting with diisocyanates and (iii) from 4 to 10 weight percent of a di-isocyanate; and (c) from more than zero to 20 weight percent of an energetic plasticizer;

said weight percents being based on the total weight of the high-strength energetic support component; and said high-strength energetic support component comprising from 5 to 15 percent of the length of the multi-component propellant charge.

2. The propellant charge of claim 1 wherein the ratio of equivalents of trifunctional crosslinking agent to polyalkene glycol is from 0.5:1 to 1:1.5.

3. The propellant charge of claim 2 wherein the diisocyanate is an aromatic dissocyanate in a amount such that the NCO:OH ratio is from 1:1 to 1:1.1.

4. The propellant charge of claim 1 wherein the burning rate of said support component is from 50 to 150 percent of said thrust component.

5. The propellant charge of claim 4 wherein the energy content of said support component is from 50 to 75 percent of said thrust component.

6. The propellant charge of claim 3 wherein said alkylene glycol of said support component is selected from the class consisting of polyethylene glycol and polypropylene glycol.

7. The propellant charge of claim 5 wherein said alkylene glycol is polyethylene glycol.

8. The propellant charge of claim 3 wherein said alkylene glycol is a mixture of polyethylene glycol with two average molecular weights, a first average molecular weight from about 150 to about 250 and a second average molecular weight from about 350 to about 500 in a second-to-first weight ratio from about 1.8 to about 3.0.

9. The propellant charge of claim 3 or claim 8 wherein said crosslinker is selected from the class consisting of trimethylolpropane, methylene bisortho-chloroaniline, glycerol triricinoleate, 1,2,6-hexanetriol, and mixtures thereof.

10. The propellant charge of claim 3 wherein said oxidizer is present in an amount in excess of the stoichiometric amount by 10 percent.

11. The propellant charge of claim 5, wherein said energetic plasticizer is present in an amount from about 15 to about 20 weight percent.

12. The propellant charge of claim 9 wherein said energetic plasticizer is present in an amount from about 15 to about 20 weight percent.

13. The propellant charge of claim 12 wherein said energetic plasticizer is selected from the class consisting of 2,2-dinitropropyl-4-nitrazapentanoate, metriol trinitrate, bis(2,2 dinitropropyl)acetal, bis(2,2dinitropropyl)-formal, and mixtures thereof.

14. The propellant charge of claim 5, 11, or 13 wherein said isocyanate is selected from the class consisting of 2,4-toluene di-isocyanate, 2,6 di-isocyanate, phenylene di-isocyanate, and mixtures thereof.

* * * * *